US005168906A

United States Patent [19]

Combrink

[11] Patent Number: 5,168,906

[45] Date of Patent: Dec. 8, 1992

[54] APPARATUS FOR FILLING BAGS WITH FLOWABLE BULK MATERIAL AND METHOD OF ADJUSTING THE APPARATUS

[75] Inventor: Alois Combrink, Oelde, Fed. Rep. of Germany

[73] Assignee: Haver & Boecker, Oelde, Fed. Rep. of Germany

[21] Appl. No.: 690,775

[22] Filed: Apr. 24, 1991

[30] Foreign Application Priority Data

Apr. 26, 1990 [DE] Fed. Rep. of Germany ..... 4013290

[51] Int. Cl.[5] ..... B65B 1/04

[52] U.S. Cl. ..... 141/10; 141/1

[58] Field of Search ..... 141/1, 10, 83, 102, 141/114, 128; 73/861.05, 196

[56] References Cited

U.S. PATENT DOCUMENTS

| | | | |
|---|---|---|---|
| 3,474,836 | 10/1969 | Schwake | 141/67 |
| 4,081,004 | 3/1978 | Harris | 141/10 |
| 4,348,852 | 9/1982 | Clancy | 141/1 |
| 4,351,740 | 9/1982 | Joshi et al. | 141/1 |
| 4,489,765 | 12/1984 | Yamada et al. | 141/1 |
| 4,930,343 | 6/1990 | Johnson | 73/196 |

FOREIGN PATENT DOCUMENTS 2020356 11/1971 Fed. Rep. of Germany .

*Primary Examiner*—Henry J. Recla
*Assistant Examiner*—David J. Walczak
*Attorney, Agent, or Firm*—Peter K. Kontler

[57] ABSTRACT

Apparatus for filling discrete open or valve type bags with metered quantities of flowable bulk material has a gravity flow duct the upper end of which receives metered quantities of bulk material and the lower end of which discharges successive metered quantities into discrete bags. The rate of gravity flow of bulk material in the duct is regulatable by an adjustable flow restrictor which is adjusted, each time a different bulk material is gathered into metered quantities, in such a way that the rate of flow is just below that rate which causes the descending material to clog the duct. This is ascertained by starting with an adjustment at a rate well below that which results in clogging and by stepwise increasing the rate until the period of discharge of a metered quantity abruptly increases to thus indicate that the duct is being clogged. The rate of discharge is then reduced to a value at least slightly below the rate at which clogging occurs to thus ensure that the periods of time which elapse during discharge of metered quantities of bulk material into discrete bags are as short as possible without risking clogging of the duct.

10 Claims, 3 Drawing Sheets

APPARATUS FOR FILLING BAGS WITH FLOWABLE BULK MATERIAL AND METHOD OF ADJUSTING THE APPARATUS

BACKGROUND OF THE INVENTION

The invention relates to improvements in apparatus for admitting metered quantities of flowable bulk material into discrete bags or other types of receptacles, especially into open bags or valve type bags. More particularly, the invention relates to improvements in apparatus for filling bags or other types of receptacles (hereinafter called bags for short) with metered quantities of bulk material which is caused or permitted to enter discrete bags by gravity flow. The invention also relates to a method of adjusting bag filling apparatus the above outlined character in order to ensure that discrete bags are filled with metered quantities of flowable bulk material within shortest possible periods of time.

Apparatus of the above outlined character are disclosed, for example, in Schwake et al. U.S. Pat. No. 3,474,836 and in published German patent application No. 2 020 356 to Kopp. As a rule, an apparatus which serves to fill bags with granular, pulverulent or other flowable bulk material comprises a weighing or metering vessel as a means for gathering successive metered quantities of flowable material, depending upon whether such metered quantities are to be gathered by weight or by volume. It is customary to dump a metered quantity of bulk material from the weighing vessel or from the metering vessel into a normally funnel-shaped hopper below the gathering station. The outlet at the bottom end of the hopper is connected with the open upper end of a gravity flow duct the open lower end of which is connectable with discrete open bags or valve type bags. Successive metered quantities of bulk material are caused or permitted to descend in the duct by gravity flow on their way into discrete bags. If the bags are valve type bags, the duct normally constitutes a suitably designed pipe or a system of pipes which are known as gravity flow pipes. The duct is similar if the apparatus is designed to admit metered quantities of bulk material into open bags, except that the dimensions of the gravity flow pipe or pipes are normally larger, depending on the size of the material-admitting openings of the bags.

The aforementioned published German patent application of Kopp discloses a bag filling apparatus wherein a conical flow regulating device which constitutes a flow restrictor) is disposed at the downwardly converging lower end of the hopper directly or closely above the open upper end of the gravity flow duct. The flow regulating device is movable up and down to thereby increase or reduce the cross-sectional area of the passage or path for the flow of a metered quantity of bulk material from the hopper into the duct. Thus, an adjustment of the rate of gravity flow of bulk material into an open or valve type bag at the lower end of the duct involves an upward or downward movement of the flow regulating device in the hopper. It is desirable to select the level of the flow regulating device in such a way that a metered quantity of flowable bulk material can descend into and in the gravity flow duct without risking any clogging of the duct because this would entail a pronounced lengthening of the period of time which is required to transfer a metered quantity into the bag at the lower end of the duct. In many instances, the duct is an elongated slender cone the diameter of which decreases in a direction from the upper end toward the lower end so that the likelihood of clogging in or close to the lower end increases as the rate of admission of flowable material into the upper end of the duct increases. Clogging is normally attributable to internal friction within the descending stream of flowable bulk material and/or to friction between the particles of the descending stream and the internal surface of the duct. It is well known that the period of time which is required to complete the admission of a metered quantity of bulk material into a bag by gravity flow through an upright or substantially upright duct increases dramatically if the rate of admission of material into the duct is sufficiently high to cause partial or complete clogging of the duct, particularly close to the lower end of a conical duct. In other words, the output of a bag filling apparatus is drastically reduced if the rate of flow of bulk material in the duct is too high so that the duct is clogged in the course of a bag filling operation.

The length of periods which elapse to complete a filling operation is dependent upon several non-variable parameters, such as the consistency of flowable material and the dimensions of the bags, as well as on one or more variable parameters, such as the rate of evacuation or expulsion of air from the duct and/or from the bags. In accordance with presently prevailing techniques, the flow regulating device is adjusted by hand based on the expertise of the person in charge. The arrangement is such that the person in charge selects a certain rate of gravity flow, and the thus selected adjustment is thereupon adhered to for the filling of a shorter or longer series of bags with metered quantities of flowable bulk material. In other words, the flow regulating device is adjusted prior to start of a continuous bag filling operation and the flow regulating device thereupon remains in the initially selected position. This is highly unlikely to result in the filling of bags at an optimum rate, i.e., in such a way that each bag is filled with a metered quantity of flowable bulk material within the shortest possible period of time.

It is customary to put a single person in charge of supervising the operation of an entire battery of automatic bag filling apparatus. In such bag filling plants, the person in charge of supervising the operation of several discrete automatic bag filling apparatus would be incapable of continuously monitoring the operation of each individual apparatus for the purpose of adjusting the flow regulating device in order to ensure that the bag filling operation will be carried out with maximum efficiency. As a rule, the person in charge is stationed at a certain distance from the battery of automatic bag filling machines in order to ensure that such person can readily supervise the operation of all machines. Therefore, a relatively long interval of time elapses to carry out an adjustment if an apparatus fails to operate properly, particularly if the lower end of a downwardly tapering conical duct happens to be clogged with flowable bulk material. Such clogging is also known as choking.

The output of a bag filling apparatus is higher if the distance of the adjustable flow regulating device from the bag (i.e., from the lower end of the gravity flow duct) is increased. In order to further increase the output, many presently known bag filling apparatus are operated in such a way that the contents of a weighing vessel or metering vessel are evacuated (i.e., admitted into the gravity flow duct) before an empty bag is affixed to the lower end of the duct. This is possible if the duct is long so that a certain interval of time elapses before the lower end of a stream of metered quantity of bulk material descends from the upper end into and beyond the lower end of the duct. However, the height or length of the duct cannot be increased at will, not only because such lengthening contributes significantly to the cost of the duct but also because the overall height of the bag filling apparatus must be kept within certain limits in order to ensure that such apparatus can be confined in available factory buildings.

In many instances, the aforementioned conical flow regulating device (which is installed in the hopper in such a way that its apex is located at the upper end) is movable between two different positions, i.e., between two different levels. This renders it possible to discharge the bulk material at a higher rate (in the upper position of the flow regulating device) and at a lower. rate (in the lower position of the flow regulating device). The ode of operation is normally such that the flow regulating device is held in the lower position at the time the contents (i.e., a metered quantity of a weighing or a metering vessel) are dumped into the hopper for the flow regulating device. This is considered to be desirable and advantageous in order to avoid unobstructed descent of a stream of metered quantity of flowable bulk material from the vessel directly into the duct and thence into the sack or bag at the lower end of the duct. Thus, the freshly dumped metered quantity of bulk material is supposed to impinge upon the conical surface of and to gather above the flow regulating device prior to entering the upper end of the duct. Once the entire metered quantity of flowable material has been transferred into the hopper and the rate of flow around the flow regulating device and into the duct has settled so that the descending material is accelerated from zero speed on its way into and through the duct and thence into a bag at the lower end of the duct, the flow regulating device is lifted to its upper position to permit the bulk material which has gathered in the hopper to descend into the duct at the higher of the two rates. The just discussed mode of operation is being resorted to irrespective of whether the apparatus is set up to fill open bags or valve type bags.

OBJECTS OF THE INVENTION

An object of the invention is to provide a bag filling machine or apparatus which is constructed and assembled in such a way that its output can be optimized in a simple and time-saving manner.

Another object of the invention is to provide an apparatus which can be used with the same degree of efficiency for admission of metered quantities of flowable bulk material into open bags or into valve type bags or analogous receptacles.

A further object of the invention is to provide a simple and compact bag filling apparatus which can fill successive bags at an optimum rate (i.e., within shortest possible periods of time) without risking periodic clogging of the gravity flow duct which serves for admission of material directly into bags or analogous receptacles.

An additional object of the invention is to provide an apparatus which is constructed and assembled in such a way that its output exceeds the output of conventional bag filling apparatus if its height matches the height of such conventional apparatus.

Still another object of the invention is to provide an apparatus which is constructed and assembled in such a way that its output matches or even exceeds the output of considerably taller conventional bag filling apparatus.

A further object of the invention is to provide the above outlined apparatus with novel and improved means for regulating the rate of admission of flowable bulk material into the gravity flow duct.

An additional object of the invention is to provide the above outlined apparatus with novel and improved flow regulating devices.

Another object of the invention is to provide a novel and improved method of adjusting the rate of flow of metered quantities of bulk material into discrete bags or analogous receptacles.

A further object of the invention is to provide a novel and improved method of setting up the above outlined apparatus for operation with optimum efficiency.

An additional object of the invention is to provide a novel and improved method of preventing clogging of the gravity flow duct with descending bulk material in the above outlined apparatus.

Another object of the invention is to provide a method of automatically selecting an optimum rate of admission of flowable bulk material into discrete bags in a bag filling apparatus of the above outlined character.

A further object of the invention is to provide a method which can be resorted to for optimum adjustment of a bag filling apparatus irrespective of the consistency of bulk material and irrespective of the mode of gathering successive metered quantities of flowable bulk material.

Another object of the invention is to provide a method of stabilizing the operation of a bag filling apparatus in such a way that the output matches or closely approximates the maximum output irrespective of the number of successive bags which are to be filled with a particular type of flowable bulk material.

An additional object of the invention is to provide a novel and improved method of optimizing the output of a tall, medium tall or short bag filling machine of the type wherein successive bags receive metered quantities of bulk material by way of a gravity flow duct.

A further object of the invention is to provide a novel and improved method of preventing clogging of the gravity flow duct in the above outlined bag filling apparatus.

Another object of the invention is to provide a method which can be practiced to optimize the output of existing bag filling apparatus with relatively small changes in the design of such apparatus.

Still another object of the invention is to provide a method which can be carried out within short intervals of time and with a desired degree of accuracy.

SUMMARY OF THE INVENTION

One feature of the present invention resides in the provision of a method of adjusting an apparatus for filling bags or analogous receptacles with flowable bulk materials wherein successive metered quantities of bulk material (e.g., a granular or pulverulent material) are gathered at a level above the open upper end of a gravity flow duct the lower end of which discharges bulk material into discrete bags and which is clogged by descending bulk material (to thus appreciably decrease the rate of gravity flow) when the rate of gravity flow in the duct rises to a predetermined rate or value. The method comprises the steps of monitoring the periods of time which elapse during gravity flow of successive metered quantities of bulk material into discrete bags, increasing the rate of flow of successive metered quantities—beginning with a first rate below the predetermined rate—whereby the monitored periods become shorter with each increase of the rate until the rate of flow reaches the predetermined rate with attendant abrupt lengthening of the monitored period, and thereupon decreasing the rate of flow with attendant abrupt shortening of the monitored period (as a result of admission of flowable material into the bag at the lower end of the duct without any clogging of the duct).

The method preferably further comprises the steps of comparing the monitored periods and automatically initiating the rate decreasing step when the comparing step indicates the occurrence of abrupt lengthening of the monitored period.

The rate decreasing step can include reducing the rate of gravity flow of a metered quantity of bulk material below the predetermined rate by a predetermined value, preferably by a value which invariably suffices to prevent clogging of the duct while the material is being admitted into a bag at the decreased rate but is not well below the predetermined rate to thus ensure that the gravity flow of a metered quantity of flowable material is completed within a very short period of time, preferably within the shortest possible period of time such as can be achieved when the rate of gravity flow is just below the predetermined rate.

The predetermined rate preferably exceeds the aforementioned first rate by a value which is greater than the aforediscussed predetermined value. This renders it possible to increase the rate in a plurality of steps before the rate of flow matches the predetermined rate, i.e., before the bulk material begins to clog the duct. The first rate is invariably selected in such a way that it is sufficiently below the predetermined rate in order to ensure that the gravity flow at the first rate does not entail a clogging of the gravity flow duct with descending bulk material, i.e., one ensures that the adjustment of the flow rate begins with a first rate which is invariably less than the predetermined rate so that the step of increasing the rate of flow of bulk material invariably results in an increase of flow toward that rate at which the material begins to clog the duct.

If the apparatus is designed to fill bags with flowable bulk materials having different characteristics (e.g., different moisture contents or different adhesive properties), the aforementioned monitoring, increasing and decreasing steps are preferably repeated upon each change of flowable material to prepare the apparatus for the filling of the bags at an optimum rate (namely a rate preferably just below the predetermined rate at which the duct becomes clogged with attendant pronounced reduction of the rate of flow of material into a bag) upon completion of filling of a series of bags with a particular flowable material.

The method can further comprise the step of manually generating a signal to initiate a repetition of the monitoring, increasing and decreasing steps upon completion of filling of a series of bags with a particular flowable material.

The rate increasing step can include increasing the rate at predetermined intervals, e.g., at identical intervals.

The method can further comprise the step of gathering successive metered quantities of bulk material at the aforementioned predetermined intervals, i.e., of synchronizing the gathering of flowable bulk material into successive metered quantities with successive stages of the aforementioned increasing step to thus ensure rapid determination of the optimum rate of flow of bulk material, namely a rate which is just below the predetermined rate.

Another feature of the invention resides in the provision of an apparatus for filling bags with flowable bulk materials, such as cement, plaster of paris, lime, sand, granular plastic substances or others. The improved apparatus comprises means for gathering successive metered quantities of flowable bulk material, and a gravity flow duct having an open upper end which serves to receive successive metered quantities of bulk material and a lower end which serves to discharge successive metered quantities into discrete bags. The duct is clogged with descending bulk material when the rate of gravity flow of bulk material therein rises to a predetermined rate or value. The apparatus further comprises signal generating means for monitoring the periods of time which elapse during gravity flow of successive metered quantities of bulk material into discrete bags, and at least one adjustable flow restrictor which is operatively connected with the monitoring means and has means for varying the rate of flow of bulk material in the duct to select a rate which is slightly below the predetermined rate so that the gravity flow takes place without any clogging of the duct.

The gathering means can comprise at least one weighing vessel and/or at least one metering vessel. Such a vessel can be provided with at least one outlet and with an adjustable closure which controls the outlet and constitutes or forms part of the flow restrictor. The outlet can be provided at the lower end of the vessel, and the closure can include a gate (e.g., a flap) which is pivotable about a substantially horizontal axis. The flow restrictor including such pivotable gate further includes means for pivoting the gate about the substantially horizontal axis between a plurality of different positions in each of which the bulk material issues from the vessel at a different rate. The gate can include a substantially U-shaped trough which directs flowable bulk material in a different direction in each of the plurality of different positions. The arrangement is or can be such that the trough is inclined downwardly from the pivot axis in each of the plurality of different positions of the gate.

The gate is pivotable between a closed position and an open position, and the flow restrictor further comprises means for selecting the open position of the gate. Such selecting means can comprise an adjustable stop for the gate and means for adjusting the stop in response to signals from the monitoring means. The adjusting means can comprise means for moving the stop to permit a movement of the gate further away from the closed position during a predetermined stage (particularly during a late stage) of gravity flow of each metered quantity of bulk material from the gathering means to thus increase the rate of flow of bulk material.

The gathering means can comprise a hopper above the upper end of the duct, and the at least one flow restrictor can comprise a cone (e.g., an upright cone with its apex at the upper end) in the hopper, and means for moving the cone relative to the upper end of the duct.

Alternatively, the gathering means can include at least one weighing vessel or metering vessel having an outlet which serves to discharge metered quantities of flowable bulk material into the upper end of the duct. The at least one flow restrictor then comprises an adjustable closure (such as the aforediscussed preferably trough-shaped gate) for the outlet of the at least one vessel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
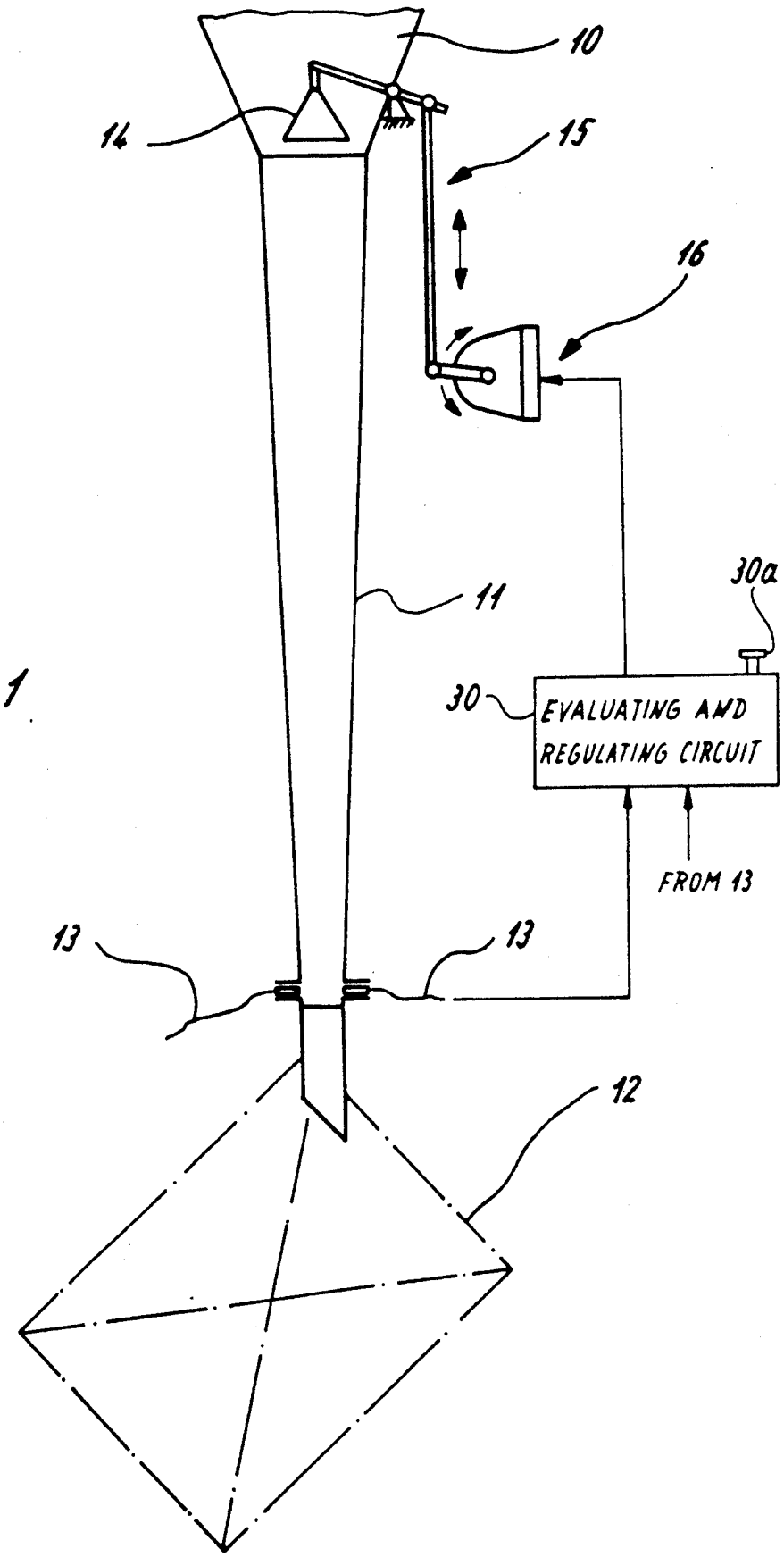
FIG. 1 is a fragmentary schematic vertical sectional view of a bag filling apparatus which embodies one form of the invention and wherein the flow restrictor includes an adjustable cone in a hopper above the upper end of a gravity flow duct.

Referring first to FIG. 1, there is shown a portion of a bag filling apparatus which comprises a hopper 10 connected to the open upper end of an upright gravity flow duct (also called drop pipe) 11 which is an elongated hollow cone and tapers downwardly toward the lower end which is separably connected with a valve type bag 12 (indicated by phantom lines). The manner in which the bag 12 is separably secured to the open lower end of the duct 12 is known and forms no part of the invention. The duct 11 has a preferably circular cross-sectional outline and carries sensors 13 which monitor the periods of time that elapse for the admission of successive metered quantities of a flowable bulk material (such as a granular or pulverulent material) from the hopper 10 into discrete bags 12. The means for gathering metered quantities of flowable bulk material in or outside of the hopper 10 can include one or more scales or one or more metering vessels of any known design. Reference may be had, for example, to the aforementioned Schwake et al. U.S. Pat. No. 3,474,836 which discloses a weighing vessel or accumulator vessel as a means for gathering successive metered quantities of flowable bulk material which is thereupon discharged into a hopper.

The bag filling apparatus of FIG. 1 further comprises a flow regulating device 14 which can be said to constitute an adjustable flow restrictor or valving element. The illustrated flow restrictor 14 is an upright cone having a base facing the open upper end of the duct 11 and an apex which is connected with one end of a linkage 15 serving to move the cone 14 up or down and to thereby change the cross-sectional area of an annular passage for the gravitational descent of a metered quantity of flowable bulk material from the hopper 10 into the duct 11. The linkage 15 can be shifted by a motorized regulator 16, e.g., a servomotor which receives impulses from a combined evaluating and regulating circuit 30. The circuit 30 has inputs for signals from the sensors 13 so that it can monitor the periods of time which elapse for the admission of successively gathered metered quantities of flowable bulk material from the hopper 10, through the duct 11, and into successive discrete bags 12. The linkage 15 can move the cone 14 substantially vertically between a plurality of different levels at each of which the cone selects a different rate of material flow from the hopper 10 into the open upper end of the duct 11. The circuit 30 is designed to automatically select that level for the cone 14 which ensures that the output of the apparatus is maximal or close to maximal, namely that the rate of material flow from the hopper 10 into a bag 12 during delivery of a metered quantity of flowable bulk material takes up the shortest possible period of time. Such setting for the cone 14 is reached when the rate of discharge of material from the hopper is just below that rate which leads to clogging or choking of the duct 11, particularly at or close to the level of the sensors 13, i.e., at or close to the locus of minimum inner diameter of the duct.

The operation of the apparatus of FIG. 1 can be automated in such a way that, once the optimum level of the cone 14 has been ascertained (e.g., before the apparatus is to proceed with the filling of a long series of bags with a different type of flowable bulk material), the cone 14 is automatically lowered by the motorized regulator 16 during the initial stage of discharge of a metered quantity of bulk material from the hopper 10. Such lowering of the cone 14 takes place during that stage when a gathering vessel (such as the aforementioned weighing vessel) is in the process of discharging a metered quantity of bulk material into the hopper 10. This ensures that the quantity of bulk material which is permitted to descend during the initial stage of filling a bag 12 and to bypass the cone 14 is relatively small. Once the entire metered quantity has been transferred from the weighing vessel into the hopper 10 and the major part of such quantity is confined in the hopper above the cone 14, the latter is raised to assume the preselected optimum position and to permit the material to descend at an optimum rate which is just below the predetermined rate that is likely or certain to result in clogging of the duct 11 and hence in considerable lengthening of the period of transfer of an entire metered quantity into the bag 12 at the lower end of the duct.

The just discussed initial lowering of the cone 14 beneath the preselected optimum position is desirable and advantageous in order to ensure that the major percentage of a metered quantity which has been admitted into the hopper 10 from a weighing vessel or the like is decelerated to zero speed and is thereupon accelerated (on its way toward the bag 12) from zero speed or nearly zero speed to a speed which is determined by the length of the duct 11.

As a rule, a standard valve type bag 12 is filled with a metered quantity of bulk material within 3.5 to 5 seconds. The period which is required to transfer a metered quantity into a standard valve type bag is increased by approximately 100 percent if the rate of discharge from the hopper into the duct 11 is increased to reach a (predetermined) rate at which the duct is clogged with descending bulk material. The shortest period of time which is required to fill a bag can be achieved if the rate of discharge of bulk material into the duct 11 is just below the aforementioned predetermined rate, i.e., when the material would clog or choke the duct (particularly the lower portion of the duct) if the rate of discharge were to be increased (by lifting the cone 14) to a relatively small extent.

In accordance with the method of the present invention, the optimum rate of discharge of bulk material from the hopper 10 into the duct 11 is selected in a series of successive steps each of which involves the discharge of a metered quantity in a different position of the cone 14, namely subsequent to movement of the cone to a higher level to thus increase the rate of discharge. One preferably starts with a first rate which is well below the predetermined rate, i.e., well below that rate at which the lower portion of the duct 11 is clogged by the stream or flow of descending bulk material forming part of a previously gathered metered quantity of such material. At the same time, the sensors 13 cooperate with the circuit 30 to ascertain and memorize the periods of time for the admission of successive metered quantities of bulk material into successive discrete bags 12.

The monitored periods become shorter from bag to bag until an abrupt lengthening of the period takes place as a result of discharge at the aforementioned predetermined rate, i.e., when the lower portion of the duct 11 becomes clogged as a result of discharge of bulk material at an excessive rate. This is ascertained by the circuit 30 which then adjusts the cone 14 by way of the regulator 16 in a sense to decrease or reduce the rate of discharge of the next metered quantity to a predetermined extent which ensures that the rate is below the predetermined rate but preferably only slightly below such rate. This is the selected or optimum rate because it ensures that the duct 11 is not clogged but at the same time guarantees the filling of successive bags 12 within shortest achievable intervals. The circuit 30 compares the monitored periods and automatically initiates the rate decreasing step when the comparing step in the circuit 30 indicates that the last monitored period is much longer than the preceding period.

The reduction of the rate of discharge below the predetermined rate can but need not be effected in several steps or stages. As a rule, it suffices to reduce the rate by a predetermined value which is known and certain to be sufficient to prevent clogging of the duct 11 during discharge of next-following metered quantities from the hopper 10 into successive bags 12.

Monitoring of the flow of material by the sensors 13 and the calculation of the period of discharge of a metered quantity immediately following a reduction of the rate (i.e., immediately following a downward adjustment of the cone 14 following a clogging of the duct 11) invariably indicates that the period of discharge has been drastically reduced (for example, by approximately 100 percent) because the previously ascertained period involved the discharge of a metered quantity which has temporarily clogged the duct 11 and the next-following period involved the discharge of a metered quantity which did not cause any clogging of the duct.

In order to ensure that the final adjustment or setting of the cone 14 is an optimal setting, it is often advisable to fill one or more additional bags with flowable material while the cone 14 has been set by lowering it following the detection of clogging. This enables the circuit 30 to verify the correctness of setting of the cone 14 which is thereupon left in the selected optimum position except that it can be lifted during the last stage of delivery of a metered quantity into a bag in order to further reduce the periods of filling the bags since the rate of flow of material from the hopper into the duct 11 tends to decrease when the hopper contains only a relatively small remaining portion or percentage of a metered quantity.

The exact construction of the circuit 30 forms no part of the present invention. Such circuit includes means for comparing successive signals from the sensors 13 to thus ascertain the periods of discharge of successive metered quantities of bulk material, a memory for storage of information which is indicative of the ascertained periods of delivery of successive metered quantities of bulk material, a suitable timer which causes the cone 14 to assume a new position upon completed discharge of a metered quantity, and means for synchronizing the movements of the cone 14 to a new position with the operation of the vessel or vessels which gather metered quantities of bulk material for admission into the hopper 10.

The starting position of the cone 14 can be selected in such a way that the predetermined (clogging) rate of discharge is reached after a substantial number of successive stepwise adjustments of the level of the cone 14, each following the discharge of a metered quantity of bulk material from the hopper 10 into a discrete bag 12. In other words, the distance through or extent to which the level of the cone 14 is changed when the adjustment of the bag filling apparatus is completed is preferably a small fraction of the extent to which the cone 14 must be adjusted from its first position to the position in which the duct 11 becomes clogged with bulk material. Otherwise stated, the extent to which the cone 14 is lowered subsequent to detection of clogging can match the extent to which the level of the cone is changed in the course of only one of a number of successive rate increasing steps.

The circuit 30 monitors the periods of time which elapse for the discharge of successive metered quantities of bulk material into discrete bags 12 and continues to transmit to the motor 16 signals which entail a lifting of the cone 14 (i.e., an increase of the rate of discharge of bulk material) as long as each of the successively monitored periods is shorter than the preceding period. The circuit 30 initiates a reversal in the direction of adjustment of the cone 14 only when it ascertains that the last monitored period was much longer than the preceding period, i.e., when the circuit 30 has (indirectly) detected that the rate of flow is excessive because it has resulted in clogging or choking of the duct 11. Thus, the critical point of a curve which denotes successively monitored periods of discharge of metered quantities of bulk material is that point where the curve indicates that the last-measured period was incomparably (or at least considerably) longer than the preceding period; this indicates that the time has come to reverse the direction of adjustment of the cone 14, namely in a sense to reduce the rate of discharge of bulk material from the hopper 10 into a bag which is connected to the lower end of the duct 11.

Once the circuit 30 has selected an optimum level for the cone 14, such level normally remains unchanged (except if the level is to be changed in an automatic way during one or more predetermined stages of filling a bag 12 in order to even further shorten the period of transfer of a metered quantity from the hopper 10) as long as the nature of bulk material remains unchanged. However, the aforementioned monitoring, rate increasing and rate decreasing or reducing steps are preferably repeated when the apparatus is to handle a different type of bulk material, e.g., a material having a higher or lower moisture content than the previously metered material. The moisture content can change even if the composition of bulk material remains the same. The manner in which the characteristics of bulk material are monitored to detect changes in moisture content and/or other changes which are likely to warrant a resetting of the cone 14 forms no part of the present invention. The circuit 30 can include a keyboard or a single key 30*a* so that the person in charge can manually initiate a resetting of the cone 14 to a different position (when such resetting is warranted in view of the changed characteristics of bulk material or because the apparatus is to begin with the filling of bags with a different bulk material).

It is preferred to select the step of reducing or decreasing the rate of bulk material flow (i.e., the last step of selection of an optimum level for the cone 14) in such a way that this step at least matches the last rate increasing step, i.e., that step which has resulted in clogging of the duct 11. This is particularly desirable if the rate of material discharge is increased in a number of relatively small steps (on the way toward that setting which results in clogging of the duct 11). As a rule, or in many instances, the rate reducing or decreasing step involves a predetermined change in the level of the cone 14, namely a change which is known to be sufficient to ensure that the duct 11 will not be clogged by the descending stream of bulk material.

It goes without saying that the initial or first setting of the cone 14 is invariably selected in such a way that it is remote from that setting which entails clogging of the duct 11, i.e., the initial setting is selected with a view to discharge bulk material at a rate which is well below the optimum rate and is hence well below the predetermined (clogging) rate. The initial setting of the cone 14 can be selected by hand or automatically by the circuit 30, depending on the sophistication of the selected circuit and/or upon the frequency at which the position of the cone 14 is to be adjusted as a result of a change of bulk material or as a result of a change of one or more relevant characteristics of one and the same bulk material. For example, the circuit 30 can automatically reset the cone 14 to a starting position which is known to be well below the position for discharge at the predetermined (clogging) level for all kinds of bulk materials which come into consideration for admission into bags or other types of receptacles.

It is further within the purview of the invention to simply leave the position of the cone 14 unchanged when the apparatus is to fill bags with a different bulk material. The circuit 30 then proceeds to lift the cone 14 by a step following each of a series of successive bag filling operations and ascertains whether or not the periods of discharge of successive metered quantities of bulk material decrease. If they do, the adjustment of the level of the cone 14 continues (by moving the cone upwardly) until the period of discharge is drastically increased to thus indicate that the rate of discharge matches the predetermined rate. If the duration of the initially measured period is indicative that the rate of discharge is too high to start with, the circuit 30 begins to initiate stepwise movements of the cone 14 in a direction toward the duct 11 until the duration of the last-measured period is much shorter than that of the previously measured period; this indicates that the rate of discharge has been lowered below the predetermined rate and that the thus ascertained period of discharge of a metered quantity is the shortest period which can be achieved with the bag filling apparatus.

As mentioned above, the circuit 30 can be provided with a keyboard or with a key 30*a* which is actuated by hand to start an adjusting operation. This enables the person in charge of one or more bag filling apparatus to initiate a new selection of the optimum level of the cone 14 whenever the person so desires. The person in charge may decide to start an adjusting operation while the apparatus is in the process of filling successive bags 12 with one and the same product. This ensures that a proper adjustment of the level of the cone 14 can be obtained without monitoring the characteristics (such as the moisture content) of bulk material which is being used to fill the bags. Thus, the circuit 30 cooperates with the sensors 13 to verify, from time to time, the accuracy of the selected setting or level of the cone 14 at a time when the apparatus continues to process one and the same product. Alternatively, the circuit 30 can embody, or can be combined with, a suitable timer which automatically initiates the aforediscussed series of steps that are necessary to ascertain the optimum level of the cone 14. Such timer can be put to use when a particular apparatus is set to process one and the same product for extended periods of time. As mentioned above, automatic determination of correctness or incorrectness of the selected position or level of the cone 14 obviates the need for continuous monitoring of the characteristics of bulk material which is being used to fill successive bags 12.

Figure 2:
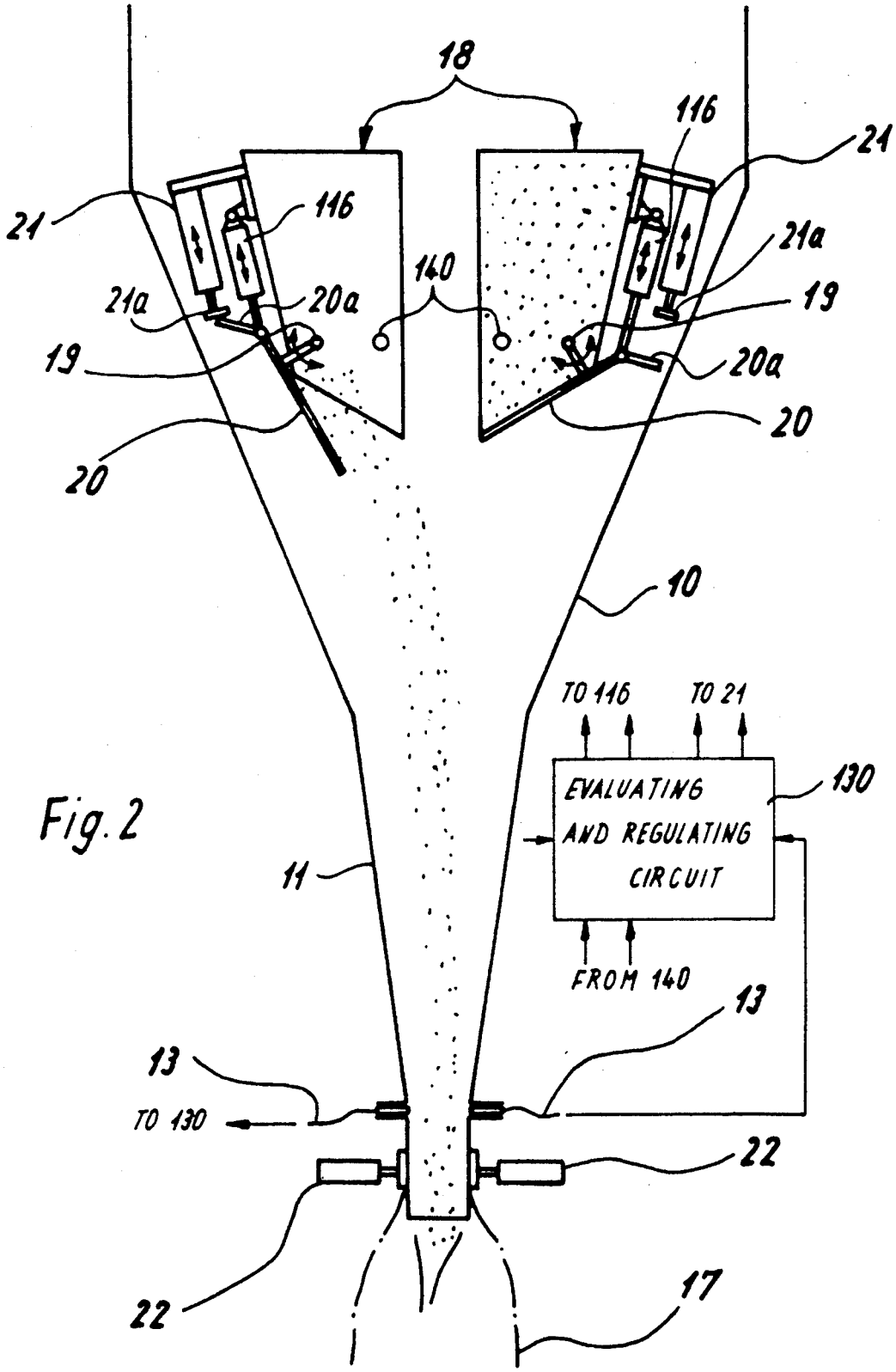
FIG. 2 is a similar fragmentary schematic vertical sectional view of a modified apparatus wherein the means for gathering metered quantities of flowable bulk material comprises two vessels in the hopper and the flow restrictor means comprises pivotable closures for the outlets at the lower ends of the vessels.

FIG. 2 shows a portion of a second bag filling apparatus in the process of admitting a metered quantity of flowable bulk material into an open bag 17. The open end of the illustrated bag 17 is temporarily connected to the lower end of a downwardly tapering conical gravity flow duct 11 by two clamping jaws 22 or in any other suitable way. The sensors 13 monitor the flow of bulk material in the lower portion of the duct 11 and transmit signals to a combined evaluating and regulating circuit 130 which, in turn, transmits signals to at least one of two motors 116 serving to adjust discrete pivotable gates 20 each of which constitutes an adjustable flow restrictor.

Figure 3:
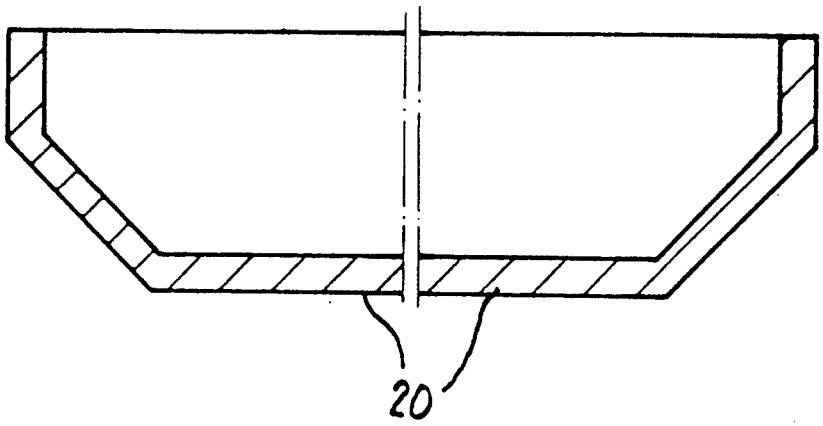
FIG. 3 is an enlarged fragmentary transverse sectional view of a pivotable gate which is used in the apparatus of FIG. 2.
Figure 4:
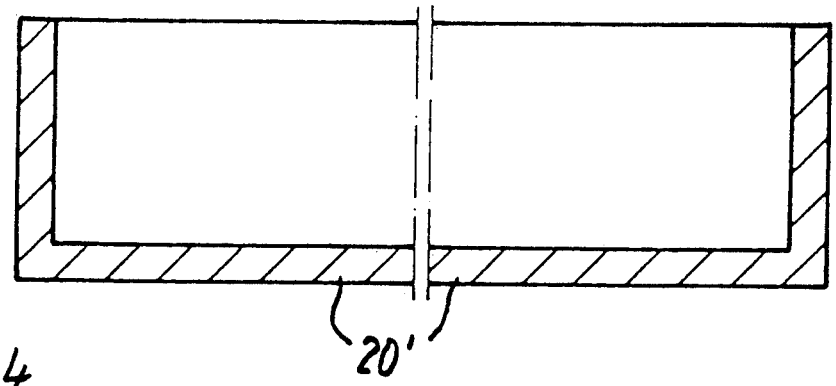
FIG. 4 is a similar enlarged fragmentary transverse sectional view of a modified gate.

The gates 20 control the rate of flow of metered quantities of flowable bulk material from two discrete weighing vessels 18 which are installed in a conical hopper 10 above the open upper end of the duct 11. Each motor 116 can constitute a fluid-operated (hydraulic or pneumatic) cylinder and piston unit which can pivot the respective gate 20 about the horizontal axis of a pivot member 19. Each of the illustrated gates 20 preferably constitutes a trough having a substantially U-shaped cross-sectional outline (see the gate 20 of FIG. 3 and the modified gate 20' of FIG. 4) so that it can control and change the direction of flow of bulk material from the respective vessel 18 in response to operation of the respective motor 116 in a sense to increase or to reduce the inclination of the gate. FIG. 2. shows that the right-hand gate 20 is held in the closed position to confine a metered quantity of bulk material in the respective vessel 18. The left-hand gate 20 is shown in an open position in which its extension 20*a* abuts an adjustable stop 21*a* serving as a means for selecting the maximum rate of outflow of bulk material from the vessel 18. The means for adjusting the levels of the stops 21*a* comprises fluid-operated motors 21 which receive signals from the circuit 130. It will be noted that each of the gates 20 slopes downwardly in each of its positions, i.e., irrespective of whether the gates are maintained in closed positions or partly open or fully open positions.

As can be seen in FIG. 2, the gate 20 which is held in the open position discharges flowable bulk material substantially or exactly into the center of the open upper end of the duct 11.

The circuit 130 is preferably designed or adjusted in such a way that the gate 20 which is in the process of permitting flow of bulk material from the respective vessel 18 is caused to move beyond the preselected optimum position when the respective vessel has already discharged a preselected portion (e.g., between 80 and 9090±) of the gathered metered quantity of bulk material. This is desirable and advantageous because the rate of outflow (in an unchanged angular position of the respective gate 20) tends to decrease as the quantity of remaining bulk material in the respective vessel 18 decreases. Such additional opening of the gate 20 which is in the process of permitting outflow of bulk material from the corresponding vessel 18 can be achieved by lifting the respective stop 21*a* and by simultaneously or immediately thereafter actuating the respective motor 116. Referring to the left-hand gate 20 of FIG. 2, this would involve a pivotal movement of the gate in a clockwise direction beyond the angular position which is shown in the drawing. Such mode of operating the apparatus of FIG. 2 contributes to a shortening of the periods of time which elapse during transfer of metered quantities of bulk material from the vessels 18 into discrete open bags 17. One of the vessels 18 is in the process of receiving a metered quantity of bulk material while the gate 20 of the other vessel is in the process of permitting controlled outflow of the metered quantity of bulk material into a bag 17 which is then connected to the lower end of the duct 11.

The illustrated vessels 20 which are assumed to gather metered quantities of bulk material by weight (i.e., by resorting to suitable scales in a manner well known in the art) can be replaced with vessels which are designed to gather metered quantities of bulk material by volume rather than by weight. Both types of vessels are or can be of conventional design.

Many presently known bag filling apparatus are equipped with pairs of weighing vessels or metering vessels which are used in the aforedescribed manner, i.e., one of the vessels is in the process of gathering a metered quantity of bulk material while the other vessel is in the process of discharging its contents into the duct 11. The gates or flaps of vessels in conventional bag filling machines are arranged to abruptly move from the closed to the fully open position, i.e., to suddenly expose the outlet of the respective vessel to a maximum possible extent. Such conventional apparatus are further equipped with a flow restrictor or flow regulating device which is disposed beneath the gates of the vessels and can resemble the cone 14 of FIG. 1.

The apparatus of FIG. 2 need not be provided with a flow restrictor beneath the vessels 18 because the gates 20 constitute the flow restrictors of this apparatus. Therefore, if the height of the improved apparatus is to match the height of a conventional apparatus, the improved apparatus can employ a much longer duct 11. Alternatively, and if the output of the improved apparatus is to be the same as that of a conventional apparatus with a flow restrictor beneath the pivotable gate or gates, the overall height of the improved apparatus can be reduced considerably, again because it is not necessary to install a flow restrictor between the gates 20 and the upper end of the duct 11.

Another important advantage of the apparatus of FIG. 2 is that the material which flows from a vessel 20 is not required to impinge upon a flow restrictor (such as a cone) after it has been permitted to leave the vessel, i.e., the material can flow into the duct 11 of FIG. 2 as soon as the respective gate 20 has been moved to a selected open position. The absence of a flow restrictor beneath the gates 20 contributes to simplicity of the apparatus and of its controls because it is not necessary to take into consideration various modes of bulk material flow (dynamically or from a standstill); all that is necessary is to select the optimum open positions of the gates 20 and to thereupon move the gates to such selected positions whenever the respective vessels 20 have accumulated metered quantities of bulk material.

The aforementioned step of moving the gates 20 further toward their fully open positions when the respective vessels 18 have discharged a large percentage (normally between 80 and 90 percent) of their contents has been found to contribute to an additional significant shortening of the periods of discharge of metered quantities of bulk material without the risk of clogging the duct 11. In this manner, the apparatus automatically compensates for a reduction of the rate of flow of bulk material from the respective vessel 18 when the pressure upon the material immediately above the respective outlet decreases due to a reduction of the overall quantity of material in the vessel as the material discharging operation progresses. If desired, the apparatus can be equipped with means for monitoring the pressure upon the body of bulk material at the outlet of each vessel 18 in order to automatically adjust the positions of the gates 20 accordingly, i.e., in the course of the actual material discharging operation. However, it has been found that, in actual practice, it normally suffices to design the combined evaluating and regulating or control circuit 130 in such a way that the stop 21*a* for the open gate 20 is automatically adjusted to a preselected extent during a particular stage of evacuation of a metered quantity of bulk material from the respective vessel. The signal for pivoting of the partially open gate 20 further toward the fully open position can be transmitted by a sensor 140 in the respective vessel 18; such sensor generates a signal when it is no longer embedded in bulk material and the signal is processed by the circuit 130 to shift the respective stop 21*a* as well as to actuate the respective motor 116 in order to ensure that the corresponding gate is pivoted toward its fully open position and again abuts the stop 21*a* in the newly selected position of such stop.

If the vessels 18 are weighing vessels, the sensors 140 can be omitted and the scales of the vessels are then designed to transmit to the circuit 130 signals which initiate an adjustment of the stops 21*a* when the weight of bulk material in the respective vessels has been reduced to a preselected value (e.g., to between 10 and 20 percent of the weight of a metered quantity of bulk material). The scales can be of the adjustable type so that the stops 21*a* are adjusted during any selected stage of evacuation of a metered quantity of bulk material from the respective vessel.

The apparatus of FIG. 2 exhibits the advantage that it is simpler than heretofore known apparatus with two weighing or metering vessels because it need not employ a flow restrictor beneath the two vessels. As mentioned above, this renders it possible to increase the length of the duct 11 if a higher output is desirable or necessary, or to reduce the length or height of the duct 11 without reducing the output of the improved apparatus below that of a taller conventional apparatus. The height of the duct 11 can be reduced by a value corresponding to that portion of the height of the hopper in a conventional bag filling apparatus which is required to accommodate a flow restrictor (e.g., a vertically movable cone) at a level between the weighing or metering vessel or vessels and the upper end of the duct.

The apparatus of FIG. 2 can be used with particular advantage for the filling of open bags 17. As a rule, an open bag of standard size can be filled within a period of 0.6 to 1.1 second.

If the improved apparatus is equipped with a longer duct 11 because it is not necessary to provide a flow restrictor between the gates 20 and the upper end of the duct, the increased speed of flow of bulk material at the lower end of the thus lengthened duct contributes significantly to a much higher output of the apparatus. Thus, the output can be increased considerably without an increase in overall height of the apparatus (as compared with the height of a conventional apparatus wherein a flow restrictor is installed in the hopper between the weighing or measuring vessel or vessels and the upper end of the duct) because the duct of the improved apparatus is longer. Such higher output is achieved even though the rate of flow of bulk material from the vessels 20 is slower than in conventional apparatus wherein the gates are abruptly pivoted from closed to fully open positions. The reason is that, as a rule, the dimensions of the vessels are greater than necessary or required.

The manner of selecting the optimum positions for the gates 20 with the sensors 13 and circuit 130 is analogous to the manner of selecting the optimum level of the cone 14 in the apparatus of FIG. 1. Thus, the circuit 130 increases the rate of discharge of bulk material into successive bags 12 and memorizes the monitored periods of time. When an adjustment of the angular position of the gate 20 entails an abrupt lengthening of the period of discharge of a metered quantity of bulk material, the circuit 130 reverses the direction of adjustment of the respective gate 20 (toward the closed position) to thus ensure that the rate of discharge is just below the predetermined (clogging) rate. The sensors 13 can be designed to generate signals as long as they detect the presence of bulk material in the adjacent portion of the duct 11. Optical sensors can be used with considerable advantage.

The gates 20 or 20' constitute the metering elements of the apparatus which is shown in FIG. 2, i.e., they perform the function of the metering cone in the apparatus of FIG. 1. This renders it possible to increase the distance of the metering means from the bag 17 (with attendant increase of the output) or to shorten such distance without reducing the output below that of a conventional apparatus. The metering operation is completed within a very short interval of time so that, in spite of the somewhat longer period of evacuation of bulk material from a vessel 20 (due to controlled movement of the respective gate), the number of possible metering operations can exceed one-half of the bag fillings. Thus, the lengthening of periods of evacuation due to controlled movements of the gates 20 or 20' does not adversely affect the output.

It has been found that the improved apparatus can be used with particular advantage for the filling of bags or analogous receptacles with granular bulk material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of adjusting an apparatus for filling bags with flowable bulk materials wherein successive metered quantities of bulk material are gathered at a level above a gravity flow duct, the duct having an open upper end for the admission of bulk material therein and a lower end which discharges bulk material into discrete bags, and the duct being clogged by descending bulk material when the rate of gravity flow therein rises to a predetermined rate, the apparatus including adjustable flow restricting means for varying the rate of flow in the duct, means for monitoring and evaluating the periods of time which elapse during gravity flow of successive metered quantities of bulk material into discrete bags, and motor means for the flow restricting means operatively associated with the monitoring and evaluating means, said method comprising the steps of monitoring the periods of time which elapse during gravity flow of successive metered quantities into discrete bags; increasing the rate of flow of successive metered quantities, beginning with a first rate below said predetermined rate, whereby the monitored periods become shorter with each increase of said rate, until the rate of flow reaches said predetermined rate with attendant abrupt lengthening of the monitored period; and thereupon decreasing the rate of flow with attendant abrupt shortening of the monitored period.

2. The method of claim 1, further comprising the steps of comparing the monitored periods and automatically initiating said rate decreasing step when said comparing step indicates said abrupt lengthening of the monitored period.

3. The method of claim 1, wherein said rate decreasing step includes reducing the rate below said predetermined rate by a predetermined value.

4. The method of claim 3, wherein said predetermined rate exceeds said first rate by a value greater than said predetermined value.

5. The method of claim 1, wherein said first rate is sufficiently below said predetermined rate to ensure that the gravity flow at such first rate does not entail a clogging of the gravity flow duct with descending bulk material.

6. The method of claim 1 of adjusting an apparatus for filling bags with different flowable bulk materials, further comprising the step of repeating said monitoring, increasing and decreasing steps upon each change of flowable bulk material.

7. The method of claim 6, further comprising the step of manually generating a signal to initiate repetition of said monitoring, increasing and decreasing steps.

8. The method of claim 1, wherein said rate increasing step includes increasing said rate at predetermined intervals.

9. The method of claim 8, wherein said intervals are identical intervals.

10. The method of claim 8, further comprising the step of gathering successive metered quantities of bulk material at said predetermined intervals.

* * * * *